United States Patent [19]

DeHart

[11] Patent Number: 4,687,884

[45] Date of Patent: Aug. 18, 1987

[54] LOW DRAG CONDUCTOR

[75] Inventor: Dwain L. DeHart, Massena, N.Y.

[73] Assignee: Aluminum Company of America, Pittsburgh, Pa.

[21] Appl. No.: 733,957

[22] Filed: May 14, 1985

[51] Int. Cl.[4] ..... H01B 5/08

[52] U.S. Cl. ..... 174/130; 174/42; 174/128 R

[58] Field of Search ..... 174/128 R, 130, 42; 57/206; 52/84; 244/130; 273/232

[56] References Cited

U.S. PATENT DOCUMENTS

| | | | |
|---|---|---|---|
| 1,286,834 | 12/1918 | Taylor | 273/232 |
| 2,261,558 | 11/1941 | Orloff | 244/130 |
| 2,899,150 | 8/1959 | Ellis, Jr. | 244/130 |
| 3,184,184 | 5/1965 | Dorman et al. | 244/130 |
| 3,286,019 | 11/1966 | McLoughlin et al. | 174/42 |
| 3,378,631 | 4/1968 | Edwards | 174/130 |
| 3,581,449 | 6/1971 | Huber | 174/42 X |
| 4,284,276 | 8/1981 | Worst | 273/232 |
| 4,356,346 | 10/1982 | Sakabe | 174/130 |
| 4,434,957 | 3/1984 | Moritz | 244/130 X |
| 4,436,954 | 3/1984 | Kaderjak et al. | 174/128 R |

OTHER PUBLICATIONS

A. Sakakibara, H. Iisaka, Kansai Electric Power Co., Inc., and N. Mori, T. Okumura, T. Kawamura, Sumitomo Electric Industries, Ltd., "Development of Low-Wind-Pressure Conductors for Compact Overhead Transmission Line."

S. Sakabe, H. Shimokura, Kansai Electric Power Co., Inc. and T. Okumura, Sumitomo Electric Industries, Ltd., "On the Reduction of Wind Loading on Overhead Transmission Line" Presented at International Conference on Large High Voltage Electric Systems, Symposium 22-81, Stockholm 1981.

*Primary Examiner*—Morris H. Nimmo

*Attorney, Agent, or Firm*—Elroy Strickland

[57] ABSTRACT

A conductor for overhead transmission of electrical energy. The conductor comprises an inner core and an outer conductor layer comprised of a plurality of strands helically wound on and lengthwise of the core. The strands are of trapezoidal shape in cross-section and have outwardly facing surface provided with deformations spaced apart along the length of the strands. The deformations are effective to reduce the drag of the air moving against and across the conductor.

2 Claims, 15 Drawing Figures

WIND TUNNEL TESTS ON TWICE-SIZE MODELS

ROUND STRAND

STANDARD TRAPEZOID WITH DIMPLES

SAKABE

PROJECTED WIND DRAG FORCE ON AREA-EQUIVALENT CONDUCTORS

LOW DRAG CONDUCTOR

BACKGROUND OF THE INVENTION

The present invention relates generally to overhead transmission conductors and particularly to a conductor that has reduced drag when non-laminar (i.e.; turbulent) air flows across the conductor.

In areas of the world subject to hurricanes and like phenomena, drag on overhead transmission line conductors, when subjected to high velocity winds, becomes a very important consideration in the design of transmission lines. Hence, over the years, there have been many attempts to design overhead conductors that have reduced wind drag.

A recent conductor structure and design in this area is disclosed in U.S. Pat. No. 4,356,346 to Sakabe. Sakabe employs a plurality of segmented conductor elements disposed annularly about a core of the conductor. Outside corners of the conductors are provided with a radius that forms circumferentially spaced and longitudinally extending grooves. Such grooves are stated as being effective to reduce the coefficient of drag in terms of the Reynolds Number used in designing conductors. The Reynolds Number is a factor that is dependent upon the diameter of the conductor, the velocity of the air moving across the conductor, and kinematic viscosity. The Reynolds Number ($N_R$)can be expressed as follows:

$$N_R = \frac{\text{Air Velocity} \times \text{Conductor Diameter}}{\text{Kinematic Viscosity}}$$

Kinematic viscosity varies with atmospheric pressure and temperature. Kinematic viscosity is equal to:

$$\frac{\text{air viscosity}}{\text{air density}}$$

Similar structures and analyses are presented in two papers entitled respectively "On the Reduction of Wind Loading Overhead Transmission Line" by S. Sakabe et al, and "Development of Low Wind Pressure Conductors for Compact Overhead Transmission Line" by A. Sakakibara et al. The first paper is Report No. 111-04 published by the International Conference on Large High Voltage Electric Systems, while the second paper is a report by the IEEE, numbered 84WM228-3.

BRIEF SUMMARY OF THE INVENTION

In making wind tunnel tests on the conductor of the present invention, as presently to be described, and three other conductor designs, including the segmented conductor of the above Sakabe patent, it was found that the standard cylindrical conductor having an outside layer of round, longitudinally stranded wires, exhibited a drag that was considerably less than the standard segmented or trapezoidal shape stranding. In addition, the drag exhibited by the cylindrical, round stranded conductor was somewhat less than that of the cable disclosed in the Sakabe patent at certain Reynolds Numbers. At higher Reynolds Numbers, the coefficient of drag of the round, stranded conductor is not as low as that of the Sakabe conductor. The conductor of the present invention, however, proved to exhibit a lower drag than that of the Sakabe conductor over a broad range of Reynolds Numbers.

The conductor of the present invention uses segmented, trapezoidal strands wound on the surface of an inner core of material. The outside surfaces of the segments are provided with discontinuous depressions or raised portions that are effective to lower wind pressure on the conductor.

THE DRAWINGS

The invention, along with its advantages and objectives, will be best understood from the following detailed description and the accompanying drawings in which.

Figure 5A:
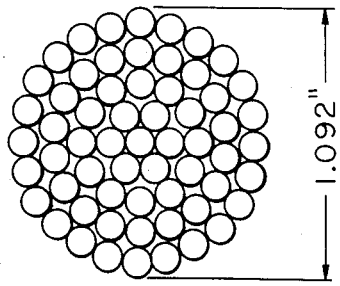
FIG. 5A PRIOR ART
Figure 5B:
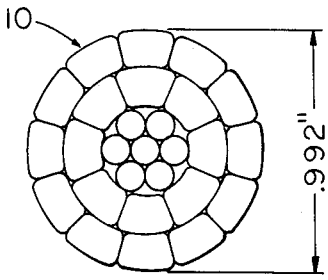
Figure 5C:
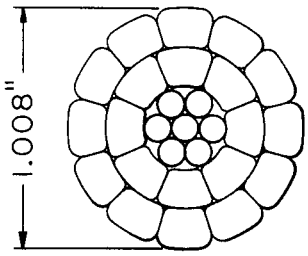
FIG. 5C PRIOR ART
Figure 4:
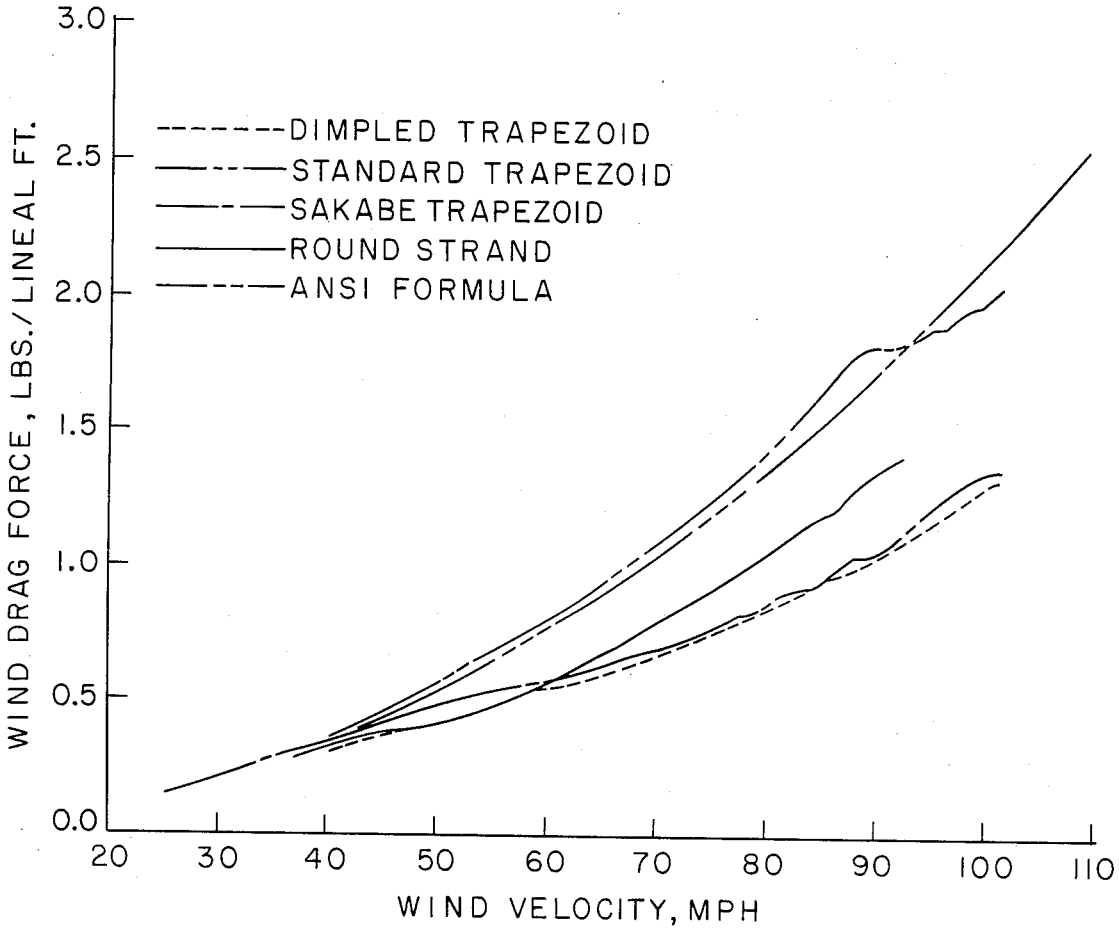

FIG. 4 is a graph projecting wind forces against wind velocity for the four conductor types, all of which have equivalent cross-sectional areas; and FIG. 5B show the conductor of the invention (center) compared to a typical ACSR conductor with rounded strands FIG. 5A and the segmented conductor of the above U.S. patent to Sakabe FIG. 5C; the cross-sectional area of metal of the three conductors is the same.

FIGS. 6 through 13 show additional embodiments of strand deformations of the invention.

PREFERRED EMBODIMENTS

Figure 1:
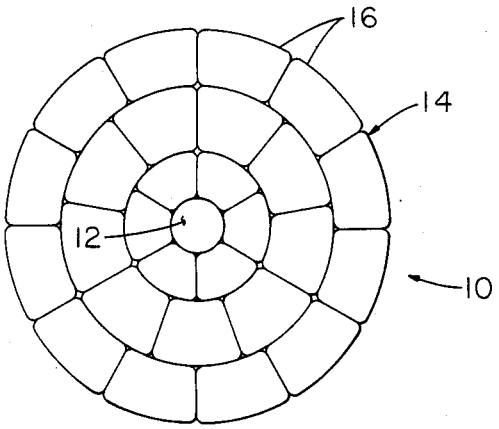
FIG. 1 is an end elevation view in somewhat schematic form of the conductor of the invention.
Figure 2:
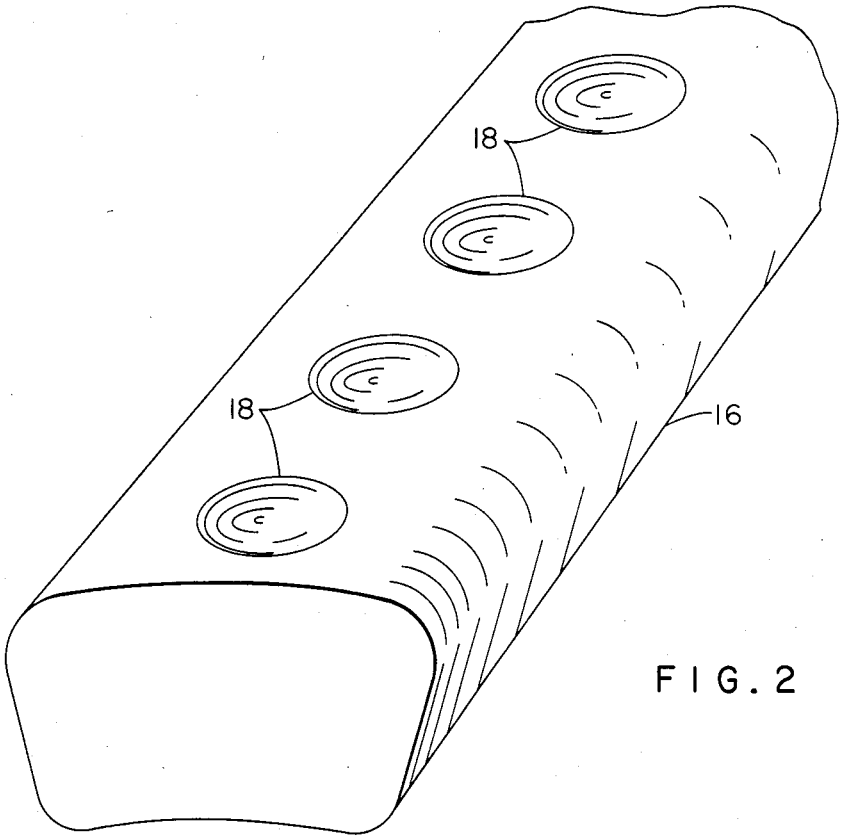
FIG. 2 is an isometric view of one of the outer strands of the conductor of FIG. 1.

Referring now to the drawings, FIG. 1 thereof shows the end of a conductor 10 to be strung in an overhead manner and thus subject to the forces encountered when the wind blows against the strung conductor. The conductor is comprised of an inner core 12 and at least one layer 14 of trapezoidal-shaped strands or wires 16 longitudinally stranded on the surface of the core. The outer edges of the strands are slightly rounded, as seen in FIGS. 1 and 2, though the outer overall surface of layer 14 approaches that of a smooth cylinder. Conductor 10 can be a typical ACSR construction in which case core 12 would comprise a plurality of stranded steel wires having round, non-segmented shapes in cross-section.

Figure 10:
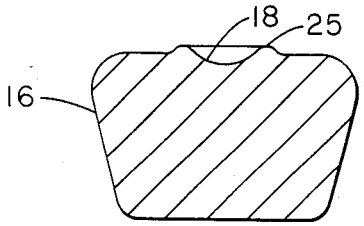
Figure 13:
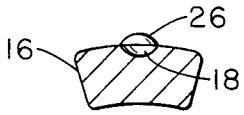

As shown in FIG. 2, the outwardly facing surface of each strand or wire 16 is provided with discontinuous deformations, i.e., depressions or dimples 18 serially disposed along the length of the strand. In cross-section, essentially round depressions are shown in FIGS. 10 and 13, though the invention is not limited thereto. The diameters or widths of the deformations and the distance at which they are spaced depend upon the diameter of the conductor and the width of the strand.

Wind tunnel tests were conducted on the type of conductor shown in FIGS. 1 and 2 of the drawings, as discussed in detail below, and on three additional conductor designs, namely, (1) a standard cylindrical (in cross-section) conductor having an annular layer of round strands longitudinally wound on a center core, (2) a conductor having an annular layer of standard trapezoidal-shaped outer strands (which forms an essentially smooth cylindrical surface to the wind), and (3) the grooved conductor disclosed in the Sakabe patent discussed above.

More particularly, the tests were conducted on conductor models that represented one-inch diameter conductors. The maximum velocity of the wind in the tunnel was 51.6 mph. In order to simulate hurricane wind velocities, i.e., on the order of 100 mph winds, the diameters of conductor models were doubled to about two inches in diameter; the doubling in diameter doubled the "front" encountered by the wind blowing in a perpendicular direction to and against each conductor.

For the tests, the standard round wire conductor had an outer layer of 24 strands, while the remainder of the conductors tested had 12 trapezoidal-shaped strands as an outside layer disposed on an inner core. The outer layer 14 of the trapezoidal strands of the conductor of FIG. 1 were deformed by forming 0.18-inch diameter (approximately) depressions in their outer surfaces. The depth of the depressions were about 0.045 to 0.060 inch deep and spaced at about 0.31-inch intervals.

Figure 3:
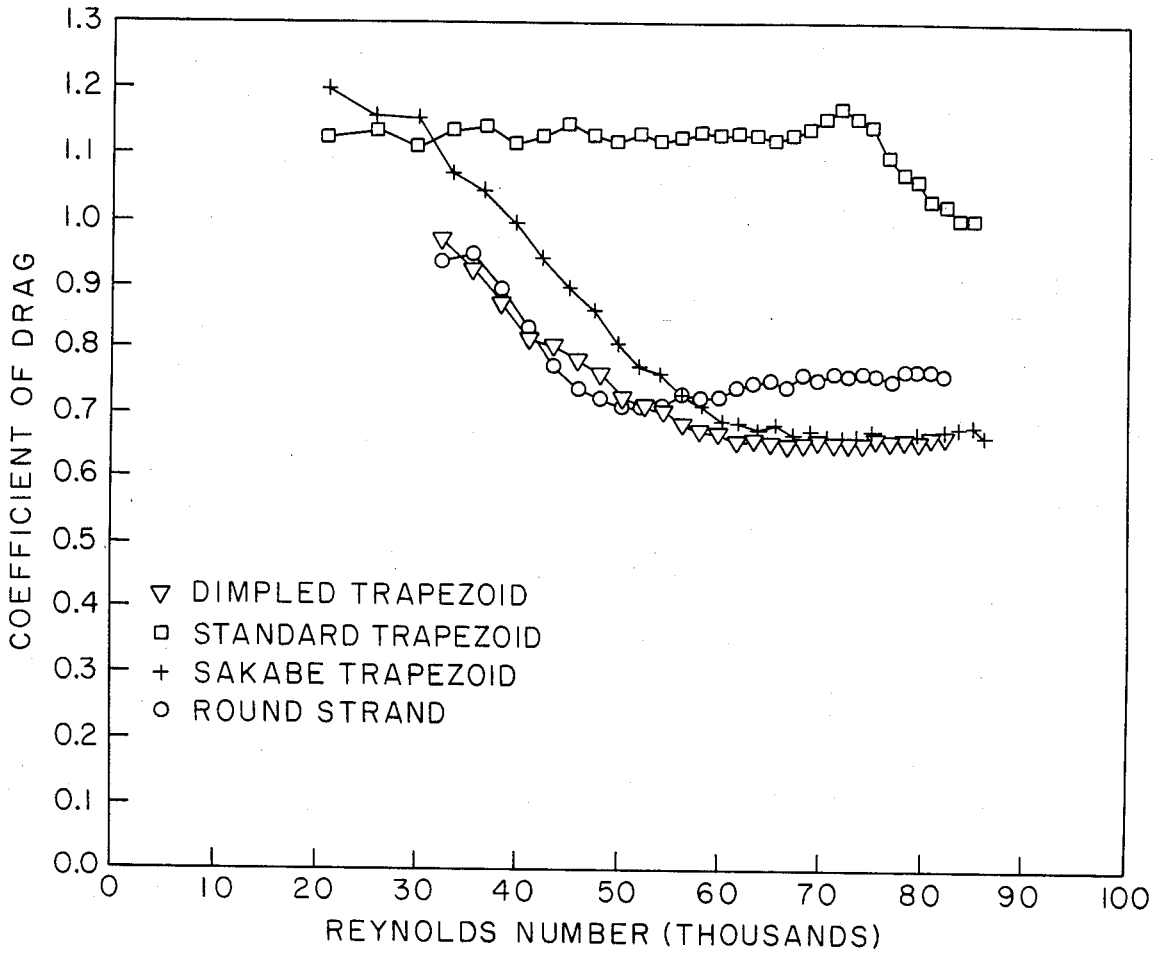
FIG. 3 is a graph comparing the coefficient of drags of the four conductor types discussed above.

The results of these tests are depicted graphically in FIGS. 3 and 4 by four curves that represent the behavior of the four conductors. A fifth (ANSI) curve in FIG. 4 is discussed below. The curves in FIG. 3 plot the coefficient of drag (that the four conductors presented to the wind in the tunnel blowing in a direction perpendicular to the axes of the conductors) against Reynolds Numbers. As seen in the graph of FIG. 3, the conductor with the highest drag is the conductor with the standard trapezoidal strands, though, at lower Reynolds Numbers, the respective drags are more nearly the same. At Reynolds Numbers approaching 100, which represent wind velocities of hurricane portion, the conductor of the invention was effective in reducing wind drag by ten to fourteen percent over that of the round wire conductor as indicated by the two respective performance curves of FIG. 3. Generally, though, the standard round wire conductor and the Sakabe conductor exhibited considerably less drag than the standard trapezoidal conductor.

The best performer in terms of reduced drag over a broad range of Reynolds Numbers, however, as proven by the above wind tunnel tests, was the conductor of the present invention, i.e., the conductor having trapezoidal strands provided with spherical depressions provided in the outwardly facing surfaces of the strands. Conductors having the standard trapezoidal-shaped strands are desirable because of the greater current-carrying capacity and lower energy losses for a given conductor diameter. This is best appreciated when viewing the three conductors of FIGS. 5A through C. The area of metal in cross-section is the same for the three conductors. However, because of the use of standard trapezoidal strands, the dimpled conductor of the invention is made more compact; a more compact conductor is therefore made available for the electrical transmission line industry; FIG. 5B is the conductor of the invention.

Current designs for transmission lines are based on the American National Standard (ANSI C2) known as the "National Electric Safety Code" (NESC). Rule 250 of this Code provides the following formula for calculating the minimum design wind loads on cylindrical surfaces:

$$P=0.00256V^2$$

where:

P=pounds per square foot

V=wind velocity in miles per hour.

A plot of this formula is shown in the test results of FIG. 4 to demonstrate the advantages of low drag conductors.

As seen in FIG. 4, which figure plots wind velocity against drag force in pounds per lineal foot, the best performer is (again) the dimpled conductor. The drag of the dimpled conductor is substantially below the ANSI curve, which establishes drag requirements for overhead transmission lines. The drag of the dimpled conductor is also consistently below that of the Sakabe conductor.

Figure 6:
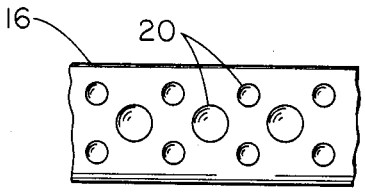
Figure 8:
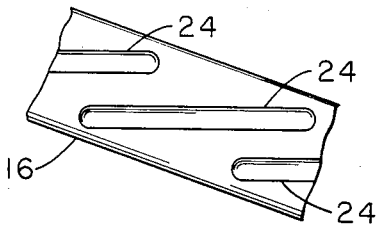
Figure 7:
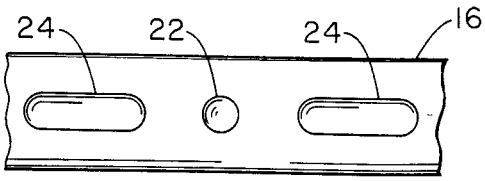
Figure 9:
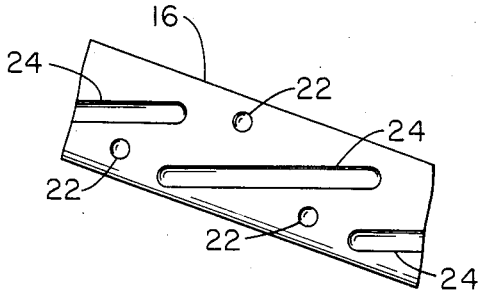
Figure 11:
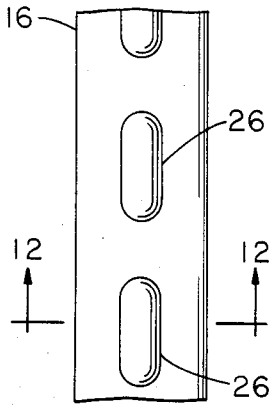
Figure 12:
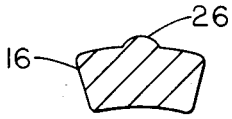

The single row of depressions shown in FIG. 2 is not the only configuration that will reduce the drag on an overhead conductor subjected to high velocity winds. For example, a mixed pattern of round dimples 20 of different diameters, as shown in FIG. 6, will reduce wind drag on a conductor. Similarly, a combination of elongated and circular depressions 22 and 24, in line with the layer of the strand, as shown in FIGS. 7 and 8, can be employed. In the case of FIGS. 8 and 9, the deformations are shown canted with respect to the lay of the strands and parallel to the center line or axis of the conductor. In FIG. 10 each depression 18 can be surrounded by a raised portion of metal 25, while the deformations shown in FIGS. 11 and 12 are themselves rounded raised portions 26. In addition, the outer surface of segmented strands 16 can be provided with a combination of depressions 18 and raised portions 26, as shown in FIG. 13 and located in the canted manner of FIGS. 8 and 9 or in line with the axis of the strand, as shown in FIGS. 7 and 11. In addition, a continuous groove or grooves and ridges (not shown) may be formed in the outwardly facing surfaces of the trapezoidal strands to reduce wind drag on the conductor.

While the invention has been described in terms of preferred embodiments, the claims appended hereto are intended to encompass all embodiments which fall within the spirit of the invention.

What is claimed is:

1. A conductor for overhead transmission of electrical energy comprising:

an inner core, and an outermost layer comprised of a plurality of conductor strands helically wound on and lengthwise of the core, each of said strands having a generally trapezoidal shape in cross-section that provides a relatively compact cylindrical conductor structure, and outwardly facing surfaces providing with rounded discontinuous depressions spaced apart along the length of the strands, said depressions being effective to reduce the drag of the air moving against and across the conductor by ten to fourteen percent over that of a cylindrical conductor having an outermost layer of round strands and an equivalent diameter in a range of Reynolds Numbers representing wind velocities of hurricane proportions.

2. The conductor of claim 1 in which the depressions are elongated and extend in a direction parallel to the axis of the conductor.

* * * * *